US011795659B2

(12) United States Patent
Jagoda

(10) Patent No.: US 11,795,659 B2
(45) **Date of Patent: *Oct. 24, 2023**

(54) SYSTEM AND DEVICE FOR ANTICIPATING AND CORRECTING FOR OVER-CENTER TRANSITIONS IN MOBILE HYDRAULIC MACHINE

(71) Applicant: DANFOSS A/S, Nordborg (DK)

(72) Inventor: Aaron H. Jagoda, Bloomington, MN (US)

(73) Assignee: DANFOSS A/S, Nordborg (DK)

( * ) Notice: Subject to any disclaimer, the term of this patent is extended or adjusted under 35 U.S.C. 154(b) by 0 days.

This patent is subject to a terminal disclaimer.

(21) Appl. No.: 17/832,203

(22) Filed: Jun. 3, 2022

(65) Prior Publication Data

US 2022/0364326 A1 Nov. 17, 2022

Related U.S. Application Data

(63) Continuation of application No. 17/256,834, filed as application No. PCT/US2019/040020 on Jun. 29, 2019, now Pat. No. 11,384,510.
(Continued)

(51) Int. Cl.
*E02F 9/22* (2006.01)
*F15B 21/00* (2006.01)

(52) U.S. Cl.
CPC ..... *E02F 9/2207* (2013.01); *E02F 9/226* (2013.01); *E02F 9/2267* (2013.01);
(Continued)

(58) Field of Classification Search
CPC ..... E02F 9/2267; F15B 2211/63
See application file for complete search history.

(56) References Cited

U.S. PATENT DOCUMENTS 5,048,296 A 9/1991 Sunamura et al.
5,832,730 A 11/1998 Mizui
(Continued)

FOREIGN PATENT DOCUMENTS

WO 2012/129042 A1 9/2012
WO 2014/193649 A1 12/2014
(Continued)

OTHER PUBLICATIONS

International Search Report and Written Opinion of the International Searching Authority for International Patent Application No. PCT/US2019/040020 dated Oct. 17, 2019, 12 pages.

*Primary Examiner* — Kenneth Bomberg
*Assistant Examiner* — Daniel S Collins
(74) *Attorney, Agent, or Firm* — Merchant & Gould P.C.

(57) ABSTRACT

A mobile hydraulic system includes a hydraulic actuator coupled to a load, and a control unit coupled to the load and/or to the hydraulic actuator. The control unit is adapted to anticipate an over-center transition of the load relative to a gravity vector prior to the over-center transition through the use of sensors configured with accelerometers, gyroscopes and magnetometers. In some examples, the over-center transition is from an overrunning driving of the load to a passive driving of the load. In some examples, the over-center transition is from a passive driving of the load to an overrunning driving of the load. In some examples, the control unit is adapted to control change in a metered flow through one or more ports of the associated actuator to minimize and/or prevent one or more hydraulic effects of the anticipated over-center transition. In some examples, the control unit controls the metered flow by causing one or more actuators (e.g., a solenoid) to shift one or more valve positions to change the flow through one or more ports of the associated actuator.

20 Claims, 10 Drawing Sheets

Related U.S. Application Data

(60) Provisional application No. 62/692,120, filed on Jun. 29, 2018.

(52) U.S. Cl.
CPC ..... *F15B 21/008* (2013.01); *E02F 9/2285* (2013.01); *F15B 2211/6336* (2013.01)

(56) References Cited

U.S. PATENT DOCUMENTS

| | | | |
|---|---|---|---|
| 6,202,013 | B1 | 3/2001 | Anderson et al. |
| 6,883,532 | B2 | 4/2005 | Rau |
| 7,143,682 | B2 | 12/2006 | Nissing et al. |
| 9,810,242 | B2 | 11/2017 | Wang |
| 10,036,407 | B2 | 7/2018 | Rannow et al. |
| 10,316,929 | B2 | 6/2019 | Wang et al. |
| 10,323,663 | B2 | 6/2019 | Wang et al. |
| 10,344,783 | B2 | 7/2019 | Wang et al. |
| 11,384,510 | B2 * | 7/2022 | Jagoda ..... E02F 9/2207 |
| 2011/0209471 | A1 * | 9/2011 | Vanderlaan ..... F15B 7/006 60/446 |
| 2016/0138619 | A1 | 5/2016 | Zhang et al. |
| 2017/0184139 | A1 | 6/2017 | Bhaskar et al. |
| 2020/0124060 | A1 | 4/2020 | Yuan |
| 2020/0124061 | A1 | 4/2020 | Yuan et al. |
| 2020/0124062 | A1 | 4/2020 | Yuan |

FOREIGN PATENT DOCUMENTS

| | | | |
|---|---|---|---|
| WO | 2015/031821 | A1 | 3/2015 |
| WO | 2015/073329 | A1 | 5/2015 |
| WO | 2015/073330 | A1 | 5/2015 |
| WO | 2015/195246 | A1 | 12/2015 |
| WO | 2016/011193 | A1 | 1/2016 |
| WO | 2018/200689 | A1 | 11/2018 |
| WO | 2018/200696 | A1 | 11/2018 |
| WO | 2018/200700 | A1 | 11/2018 |
| WO | 2020/006537 | A1 | 1/2020 |

* cited by examiner

SYSTEM AND DEVICE FOR ANTICIPATING AND CORRECTING FOR OVER-CENTER TRANSITIONS IN MOBILE HYDRAULIC MACHINE

RELATED APPLICATION

This application is a continuation of U.S. patent application Ser. No. 17/256,834, filed on Dec. 29, 2020, now U.S. Pat. No. 11,384,510, which is a National Stage Application of PCT/US2019/040020, filed on Jun. 29, 2019, which claims the benefit of U.S. Patent Application Ser. No. 62/692,120, filed on Jun. 29, 2018, the disclosures of which are incorporated herein by reference in their entireties. To the extent appropriate, a claim of priority is made to each of the above disclosed applications.

BACKGROUND

Hydraulic machine relies on hydraulic actuators, typically hydraulic actuators, to drive loads. In certain applications, and particularly mobile equipment applications, the absolute and relative orientations of each load dictate how the hydraulics associated with each actuator should be controlled for a given set of static or dynamic conditions. In controlling actuator hydraulics, it is desirable to minimize wasted energy and maximize the equipment's overall stability and smooth operability.

SUMMARY

In general terms, the present disclosure is directed to a device with improved mobile orientation sensing, and mobile hydraulic systems incorporating one or more such devices. Such mobile hydraulic systems include, for example, a piece of hydraulic machine such as a mobile crane, a backhoe or other loader, an excavator, a tractor, a telehandler, etc.

Each device is adapted to provide signals. In some examples, the device is a controller and the signals are control signals that are fed to one or more solenoids. The solenoids drive valves (e.g., spool valves) to provide metered flow (depending on the control signal) into and out of the actuator to drive the load as desired.

Equipment and load positioning and orientation are important in many mobile hydraulic machine applications. When driving a load, for example, the position and motion of the load relative to the force of gravity, relative to the surface of the ground, relative to the equipment's other loads, relative to the equipment's support structure (e.g., the chassis), etc. can all be relevant pieces of data. Likewise, the position or attitude of the equipment's support structure (e.g., the chassis) relative to the force of gravity and/or relative to the surface of the ground is important to ensure the equipment's stability.

In some examples, a device according to the present disclosure includes a sensor unit having at least two of an accelerometer, a magnetometer, and a gyroscope. In some examples, a device according to the present disclosure includes a sensor unit having all three of an accelerometer, a magnetometer, and a gyroscope. The accelerometer is adapted to measure acceleration due to gravity or a hydraulic force. The magnetometer is adapted to measure a magnetic field strength, such as Earth's characteristic magnetic field. The gyroscope is adapted to measure yaw, pitch, and roll rates. The measurements from the at least two or all three of the accelerometer, magnetometer, and gyroscope are combined to provide enhanced orientation and position information of the device.

In addition, or alternatively, different sensors from among the accelerometer, magnetometer, and gyroscope are utilized depending on the mode of the hydraulic machine, e.g., depending on whether the hydraulic machine is in initialization or other non-operating mode (power off), in start-up mode, or an operating mode.

If the device is associated with a particular component of the equipment, e.g., the chassis, or a particular hydraulic actuator (e.g., the actuator associated with the equipment's boom, arm, or bucket), the sensory inputs collected by the sensor unit are associated with that particular component of the equipment. In that case, systems, such as hydraulic machine with independently mobile components that each include one of the devices, can share the data (via electronic interconnections between the devices) collected from the different input devices to provide system-wide orientation and position information, which can be used, in conjunction with component-specific orientation and position information, to generate the needed hydraulic control signals or other signals, such as alert signals.

According to certain aspects of the present disclosure, a mobile hydraulic system includes a hydraulic actuator coupled to a load, and a control unit coupled to the load and/or to the hydraulic actuator, the control unit being adapted to anticipate an over-center transition of the load relative to a gravity vector prior to the over-center transition. In some examples, the over-center transition is from an overrunning driving of the load to a passive driving of the load. In some examples, the over-center transition is from a passive driving of the load to an overrunning driving of the load. In some examples, the control unit anticipates the over-center transition using position information associated with one or more other hydraulic actuators of the mobile hydraulic system and/or position information associated with a chassis of the mobile hydraulic system that is resting on the ground. In some examples, the anticipating of the control unit is adapted to anticipate the over-center transition at least a predetermined amount of time before the transition and/or at least a predetermined travel distance of the load before it reaches the transition point. In some examples, the control unit is adapted to control change in a metered flow through one or more ports of the associated actuator to minimize and/or prevent one or more hydraulic effects of the anticipated over-center transition. In some examples, the control unit controls the metered flow by causing one or more actuators (e.g., a solenoid) to shift one or more valve positions to change the flow through one or more ports of the associated actuator.

As used herein, an over-center transition refers to a transition from a condition in which the force of gravity assists a load-driving pivot (or other) motion caused by a hydraulic actuator associated with the load (referred to herein as overrunning or overrun driving) to a condition in which the force of gravity resists the load-driving pivot (or other) motion caused by the hydraulic actuator (referred to herein as passive), or vice versa. The transition point of the over-center transition corresponds to a condition in which the action arm of the load relative to the pivot point (or equivalent point) is aligned vertically (i.e., aligned with the force of gravity).

In one example, a mobile hydraulic system includes a hydraulic actuator coupled to a load, and a control unit operatively coupled to the load and/or to the hydraulic actuator, the control unit being adapted to anticipate an over-center transition of the load relative to a gravity vector prior to the over-center transition.

In some examples, the over-center transition is a transition from an overrunning driving of the load to a passive driving of the load.

In some examples, the over-center transition is a transition from a passive driving of the load to an overrunning driving of the load.

In some examples, the control unit anticipates the over-center transition using position and/or motion information associated with one or more other hydraulic actuators of the mobile hydraulic system and/or position and/or motion information associated with a chassis of the mobile hydraulic system that is resting on the ground.

In some examples, the control unit is adapted to anticipate the over-center transition at least a predetermined minimum amount of time before the transition and/or at least a predetermined minimum travel distance of the load before the load reaches the transition point.

In some examples, the control unit is adapted to control a change in a metered flow through one or more ports of the hydraulic actuator to reduce pressure oscillations caused by the over-center transition.

In some examples, the control unit controls the metered flow by causing one or more actuators to shift one or more directional control valves to change the flow through one or more ports of the hydraulic actuator.

In some examples, the control unit is adapted to cause a change in metered flow in response to the anticipated over-center transition only when the load is within a maximum predefined time and/or a maximum predefined distance from reaching the over-center transition.

In some examples, the control unit uses a pressure control algorithm to control motion of the load at the over-center transition.

In some examples, the control unit uses a velocity control algorithm to control motion of the load at the over-center transition.

In some examples, the load is a first load, and wherein the control unit is adapted to anticipate an over-center transition of the load relative to a gravity vector based at least in part on position and motion information of one or more other loads of the system.

In some examples, at least one of the one or more other loads is hydraulically driven independently of the first load using one or more other control units and one or more other hydraulic actuators.

In some examples, the system comprises one of a crane, an excavator, and a loader.

In some examples, the load is a rotary load.

In some examples, the control unit includes an accelerometer, a magnetometer, and a gyroscope.

In some examples, the control unit is adapted to anticipate an over-center transition of the load using data related to the geometry of components of the system, data related to initial positions of the components of the system, and data related to motion of one or more of the components of the system away from the corresponding initial position, the motion including one or more of pitch, roll, and yaw.

In some examples, a meter out margin pressure of a control valve associated with the actuator is increased as a function of one or more of the probability of the occurrence of the over-center transition, a calculated time to reach the over-center transition condition, and a rotational angle to reach the over-center transition condition. In one example, a method of controlling metered flow through a port of a hydraulic actuator adapted to drive a load includes detecting at least one position parameter and at least motion parameter for the load, anticipating an over-center transition of the load, and causing a change in the metered flow only when the load is within a maximum predefined time and/or a maximum predefined distance from reaching the over-center transition.

In some examples, the step of detecting is performed with one or more sensor units including an accelerometer, a gyroscope, and a magnetometer.

In some examples, the step of causing a change in the metered flow includes causing a change in the metered flow out of the hydraulic actuator with a control valve.

In some examples, the step of anticipating an over-center transition of the load includes calculating when a center of gravity of the load will become vertically aligned with a pivot point of the load.

In some examples, the step of anticipating includes calculating one or more of the probability of the occurrence of the over-center transition, a calculated time to reach the over-center transition condition, and a rotational angle to reach the over-center transition condition.

DETAILED DESCRIPTION

Various embodiments will be described in detail with reference to the figures, where like reference numbers correspond to like features across the several views. Reference to various embodiments does not limit the scope of the claims attached hereto. Additionally, any examples set forth in this specification are not intended to be limiting and merely set forth some of the many possible embodiments for the appended claims.

Figure 1:
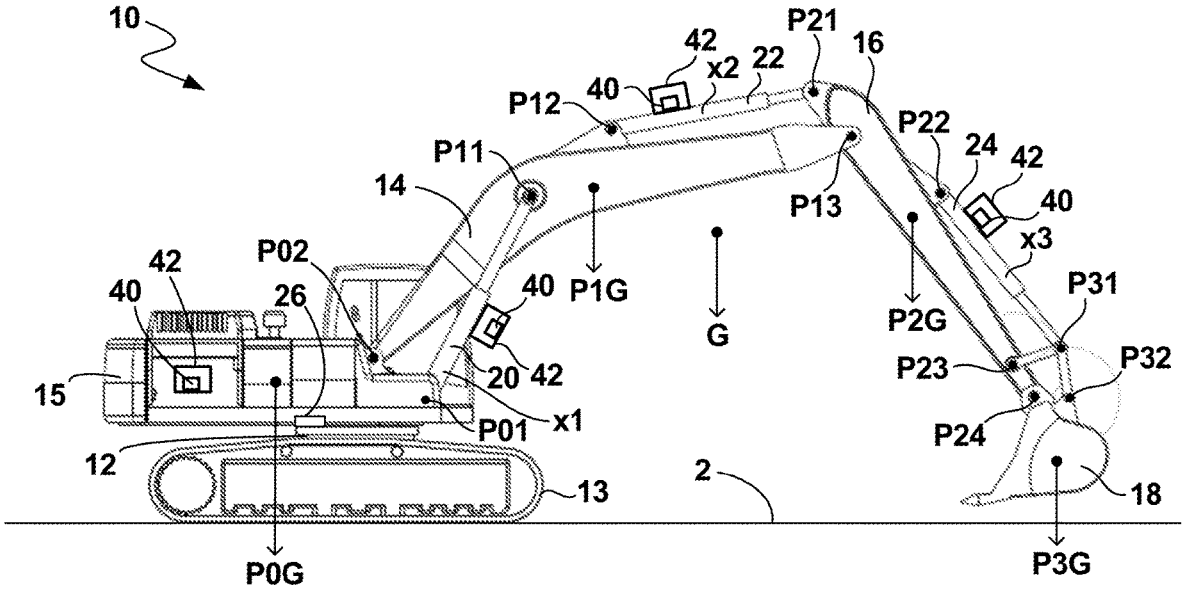
FIG. 1 is a schematic illustration of a piece of hydraulic machine according to the present disclosure.

Referring to FIG. 1, a hydraulic machine 10 is shown. In this example, the equipment 10 is an excavator. The excavator 10 includes a chassis 12 supported by wheels, tracks or other stabilizers 13 resting on a surface 2 (e.g., the ground), the wheels or tracks 13 adapted to propel the chassis along the ground 2. In the example shown in FIG. 1, the hydraulic equipment 10 is an excavator 10 with tracks 13. In the example shown at FIG. 1A, the hydraulic equipment 10 is a mobile crane or excavator truck 10 with wheels 13, wherein one or more stabilizers 30 are provided to stabilize the chassis relative to the surface 2. The following description is equally applicable to the examples shown at FIGS. 1 and 1A.

The excavator 10 includes a boom 14 and its associated hydraulic actuator 20; an arm 16 and its associated hydraulic actuator 22, and a bucket 18 and its associated hydraulic actuator 24. A hydraulic actuator 26 can also be provided to rotate the platform or upper structure 15 supporting the excavator assembly 14, 16, 18 with respect to the chassis 12. In the example shown, the actuators 20, 22, 24 are linear acting hydraulic actuators while actuator 26 is a hydraulic motor. Other configurations are possible.

Hydraulic System

Figure 2:
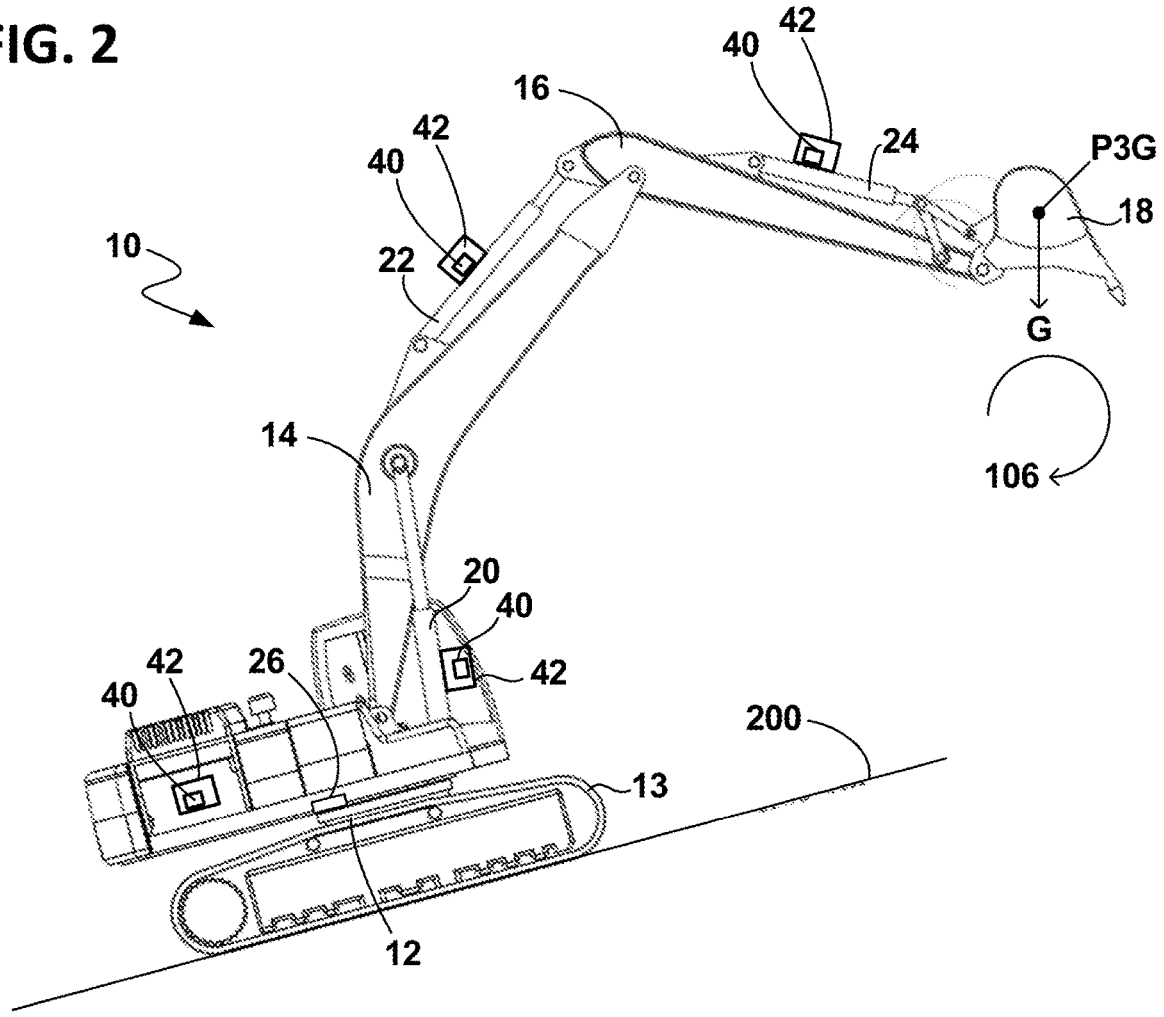
FIG. 2 is a schematic illustration of a piece of a hydraulic machine according to the present disclosure, the hydraulic machine including a load being shown before the over-center transition of FIG. 3.
Figure 6:
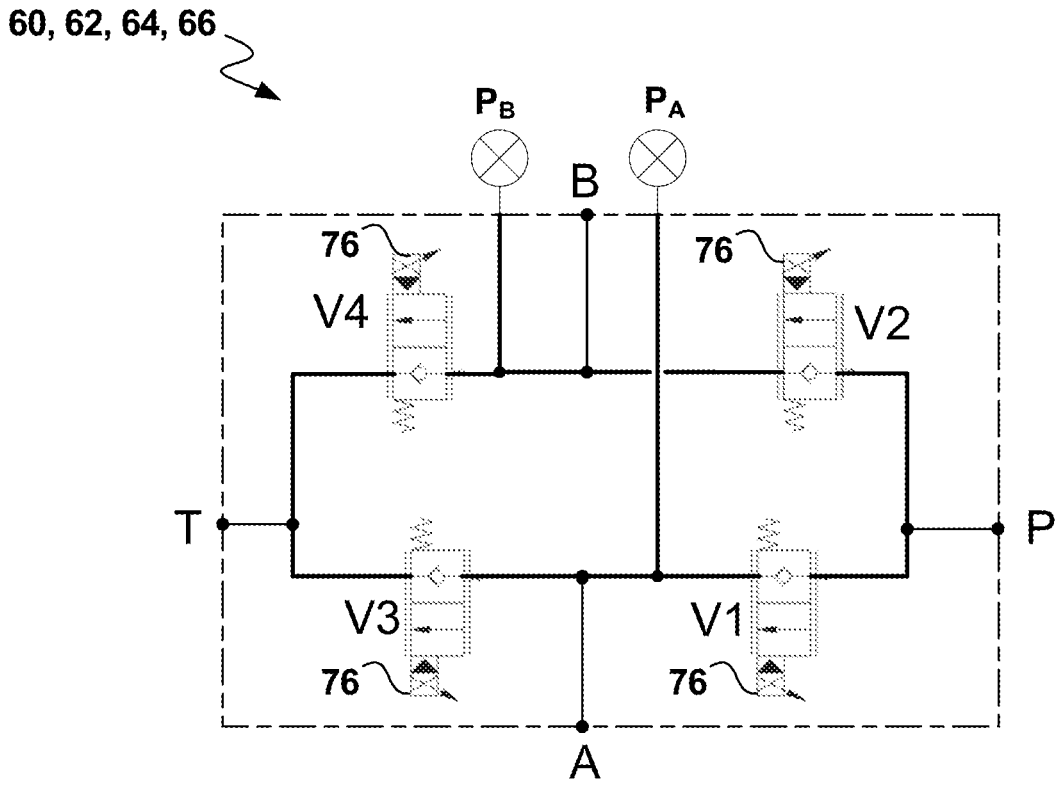
FIG. 6 is a hydraulic schematic associated with a control valve assembly of the type shown in FIG. 5.

As shown schematically at FIG. 2, the hydraulic machine 10 includes a hydraulic system 50 that includes the actuators 20, 22, 24, 26. In one aspect, the hydraulic system 50 includes a pump 52, supply lines 54, return lines 56, and a reservoir 58. The hydraulic system 50 is further shown as including control valve assemblies 60, 62, 64, 66, in fluid communication with the supply and return lines 54, 56, that are selectively controlled to operate the actuators 20, 22, 24, 26 via branch lines 68 that provide metered flow through input and output ports of each actuator. The hydraulic system 50 can also include a variety of other components, for example, branch line pressure sensors 70, supply and return line pressure sensors 72, 74, and valve actuators 76. In some implementations, one or more of the valve assemblies 60, 62, 64, 66 provide for independent metering to the associated actuator 20, 22, 24, 26, as illustrated at FIG. 6. In such cases, each control valve assembly can include a first valve V1, a second valve V2, a third valve, V3, and a fourth valve V4, wherein each of the valves is a two-position, two-way control valve with an actuator 76. As arranged, flow into and out of each of the ports A, B of an actuator is controlled by a separate valve such that the flows can be controlled by an independent control valve.

Control System

Figure 7:
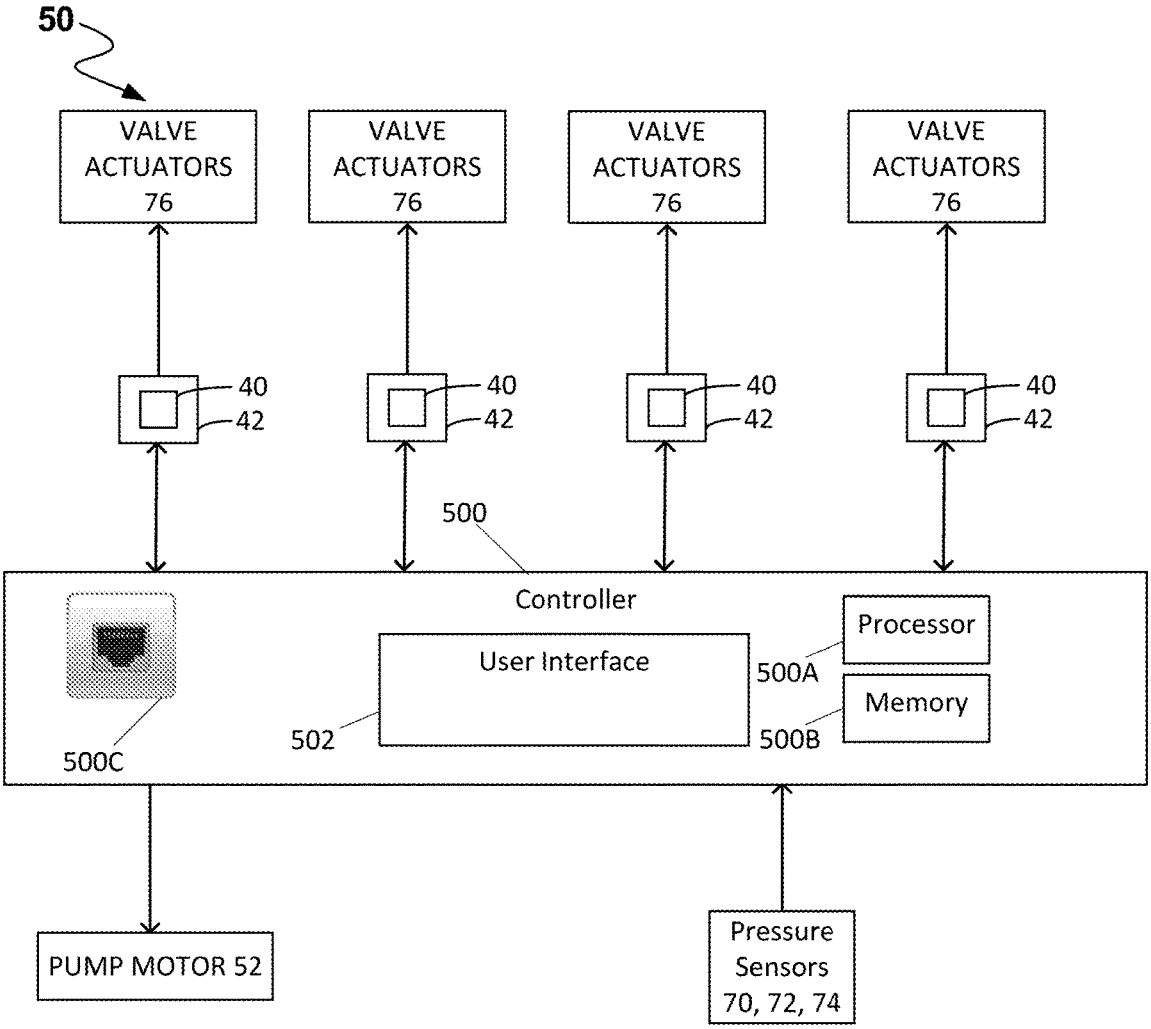
FIG. 7 is a schematic of a control system usable with the hydraulic machine shown in FIGS. 1 and 1A.

Referring to FIG. 7, the machine 10 may also include an electronic controller 500. The electronic controller 500 is schematically shown as including a processor 500A and a non-transient storage medium or memory 500B, such as RAM, flash drive or a hard drive. Memory 500B is for storing executable code, the operating parameters, and the input from the operator user interface 502 while processor 500A is for executing the code. The electronic controller is also shown as including a transmitting/receiving port 500C, such as a CAN bus connection or an Ethernet port for two-way communication with a WAN/LAN related to an automation system. A user interface 502 may be provided to activate and deactivate the system, allow a user to manipulate certain settings or inputs to the controller 500, and to view information about the system operation.

The electronic controller 500 typically includes at least some form of memory 500B. Examples of memory 500B include computer readable media. Computer readable media includes any available media that can be accessed by the processor 500A. By way of example, computer readable media include computer readable storage media and computer readable communication media.

Computer readable storage media includes volatile and nonvolatile, removable and non-removable media implemented in any device configured to store information such as computer readable instructions, data structures, program modules or other data. Computer readable storage media includes, but is not limited to, random access memory, read only memory, electrically erasable programmable read only memory, flash memory or other memory technology, compact disc read only memory, digital versatile disks or other optical storage, magnetic cassettes, magnetic tape, magnetic disk storage or other magnetic storage devices, or any other medium that can be used to store the desired information and that can be accessed by the processor 500A.

Computer readable communication media typically embodies computer readable instructions, data structures, program modules or other data in a modulated data signal such as a carrier wave or other transport mechanism and includes any information delivery media. The term "modulated data signal" refers to a signal that has one or more of its characteristics set or changed in such a manner as to encode information in the signal. By way of example, computer readable communication media includes wired media such as a wired network or direct-wired connection, and wireless media such as acoustic, radio frequency, infrared, and other wireless media. Combinations of any of the above are also included within the scope of computer readable media.

The electronic controller 500 is also shown as having a number of inputs/outputs that may be used for implementing the below described operational capabilities of the machine 10. Referring to FIGS. 1 and 7, each of the actuators 20, 22, and 24 and the chassis 12 includes an associated sensor unit 40. One or more of the sensor units 40 can be operably coupled to a control unit 42 that provides control signals to drive the associated actuator or to drive a hydraulic component of the chassis 12. In some examples, each of the sensor units 40 includes a magnetometer, an accelerometer, and a gyroscope. In some examples, the sensor units 40 are configured as "nine degree-of-freedom" (9 DOF) sensors with the ability to collect data from the magnetometer, accelerometer, and gyroscope along three axes (e.g. x, y, and z axes). The controller 500 can also include additional inputs and outputs for desirable operation of the machine 10 and related systems. For example, the controller can include outputs for an actuator 78 (e.g. an electric motor) for the pump 52 and for the actuators 76 for the control valves 60, 62, 64, 66 and can include inputs for the pressure sensors 70, 72, 74. In some examples, the control unit 42 provides a direct output to the valve actuators 76 of the control valve 60-64 associated with the actuator 20-26 to which the control unit 42 is mounted. Other configurations are possible. For example, the controller 500 provides a direct output to the valve actuators 76.

System and Operation

Figure 1A:
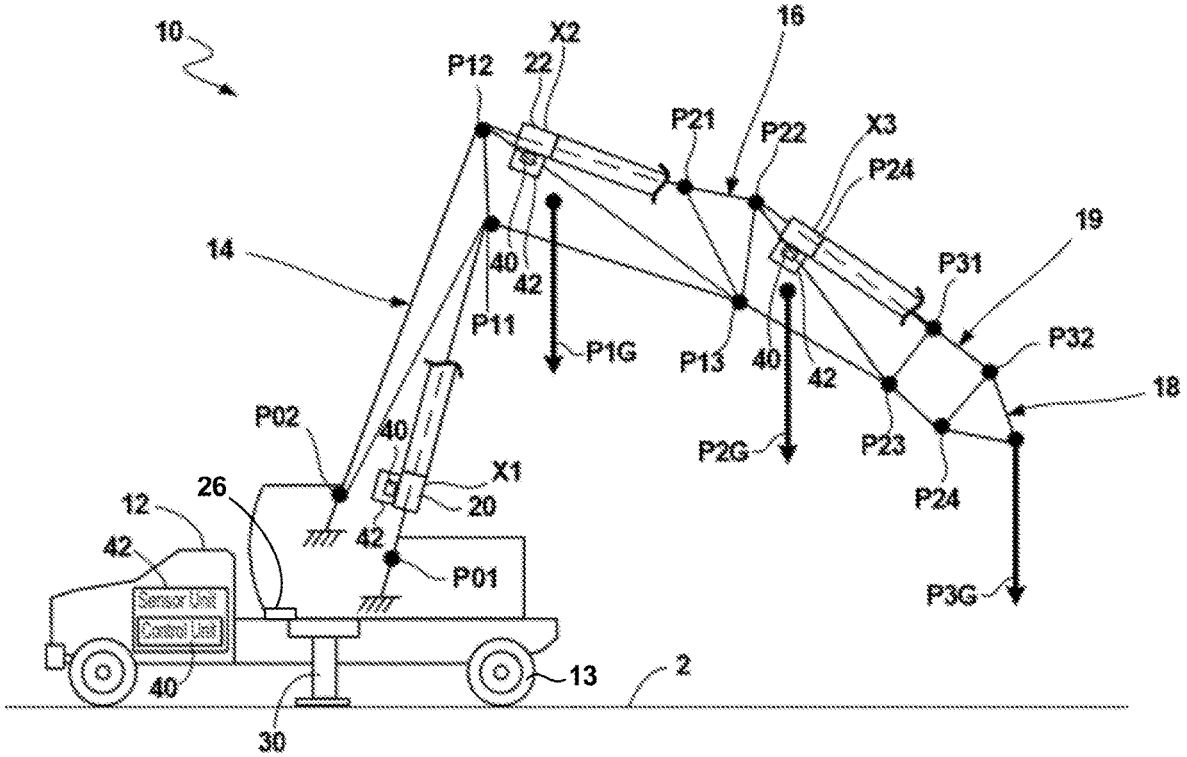
FIG. 1A is a schematic illustration of a second example of a hydraulic machine according to the present disclosure.

Referring to back to FIGS. 1 and 1A, P01 corresponds to the location where the chassis 12 couples to the boom actuator 20. P02 corresponds to the location where the chassis 12 couples to the boom 14. P11 corresponds to the location where the boom actuator 20 couples to the boom 14. P12 corresponds to the location where the boom 14 couples to the arm actuator 22. P13 corresponds to the location where the boom 14 couples to the arm 16. P21 corresponds to the location where the arm 16 couples to the arm actuator 22. P22 corresponds to the location where the arm 16 couples to the bucket actuator 24. P23 corresponds to the location where the arm 16 couples to the bucket support 19. P24 corresponds to the location where the arm 16 couples to the bucket 18. P31 corresponds to the location where the bucket actuator 24 couples to the bucket support 19. P32 corresponds to the location where the bucket support 19 couples to the bucket 18. P1G corresponds to the center of gravity of the boom 14. P2G corresponds to the center of gravity of the arm 16. P3G corresponds to the center of gravity of the bucket 18. x1 corresponds to the hydraulic state of the boom actuator 20; x2 corresponds to the hydraulic state of the arm actuator 22; and x3 corresponds to the hydraulic state of the bucket actuator 24. POG corresponds to the center of gravity of the platform 15.

Thus, for the hydraulic system corresponding to the excavator 10, the locations of P01 and P02 depend on the orientation of the ground 2; the locations of P11, P12, P13 and P1G depend on the ground 2 and x1; the locations of P21, P22, P23, P24, and P2G depend on the ground, x1 and x2; and the locations of P31, P32 and P3G depend on the ground, x1, x2, and x3. Using real time acceleration, gyroscopic, and/or magnetic inputs from the sensor units 40 on each of the actuator mounted control units 42 and the equipment geometry described in FIG. 1, a kinematic model of the excavator 10 can be generated and referred to by the control units 42 and/or a central controller or processing unit to determine positioning of the boom 14, the arm 16, and the bucket 18. Where a control unit 42 is mounted to the actuator instead of the movable load associated with the actuator, the model can include standard trigonometric and geometric correlations to calculate the condition (e.g. position, velocity, etc.) of the movable load based on the sensed conditions of the associated actuator. Where a control unit 42 is mounted directly to the movable load, such correlations may be unnecessary.

Using inputs from the sensor units 40, and selectively combining those inputs as appropriate, the orientation of each of the control units 42 is determinable. As such, in general terms, the control system can be operated such that the controller 500 receives position-related data from a plurality of sensors including accelerometers, gyroscopes, and magnetometers associated with the hydraulic machine at a step 1002.

Based on a detected orientation of a control unit 42, a corresponding orientation of the corresponding equipment component can be determined. For example, the attitude of the chassis 12 relative to the ground 2 can be determined based on a detected orientation of the control unit 42 associated with the chassis 12. That control unit can, in turn, output appropriate control signals or other signals to cause an adjustment in the attitude of the chassis 12 or the one or more stabilizers 30, and/or to provide an alert of unsafe or impending unsafe condition relating to the chassis 12.

An example initialization of a system including the equipment 10 and the various control units 42 having sensor units 40 is as follows: with the excavator 10 in a known orientation, i.e., with all of the actuators 20 fully extended, the sensor units 40 are initialized. In particular, before the valves associated with the actuators 20 and corresponding control units 42 are energized, the magnetometer of each of the sensor units 40 is used to locate magnetic north. In addition, before there is any machine motion, the accelerometer of each of the sensor units 40 is used to determine a direction to ground for the corresponding control unit 42. With the initialization data from the magnetometers and accelerometers a rotation matrix is generated for each control unit 42 so that all of the control units 42 use the same coordinate frame as the control unit 42 mounted to the chassis 12. The rotation matrices compensate for variations in installation orientation of the control units 42 to their respective equipment component. In at least some examples, the rotation matrices are stored in a memory of the overall system that includes the equipment 10, the system including one or more processors adapted to execute computer-readable instructions.

In one example initialization process, the hydraulic machine is moved to a convenient known calibration position, the solenoids of the valve actuators are de-energized to minimize interference with magnetometers, the machine is verified as being by using gyroscopes which will read zero when there is no motion, the measurements from the 3-axis accelerometer and 3-axis magnetometer are recorded. The orientation of each individual sensor is then calculated in terms of heading ($\gamma$) with respect to magnetic north, roll angle ($\alpha$) and pitch angles with respect to ground ($\beta$) using the convention x forward, z up and y left where:

$$\alpha = \arctan\left(\frac{A_y}{A_z}\right) \qquad \text{Formula 1}$$

$$\beta = \arctan\left(\frac{-A_x}{A_y\sin(\alpha) + A_z\cos(\alpha)}\right)$$

$$\gamma = \arctan\left(\frac{M_z\sin(\alpha) - M_y\cos(\beta)}{M_x\cos(\beta) + M_y\sin(\beta)\sin(\alpha) + M_z\sin(\beta)\cos(\alpha)}\right)$$

In one example, the rotation matrix ($R_i$) for each sensor (i) is developed according to the following formula:

$$R = \begin{bmatrix} \cos(\gamma) & -\sin(\gamma) & 0 \\ \sin(\gamma) & \cos(\gamma) & 0 \\ 0 & 0 & 1 \end{bmatrix} \begin{bmatrix} \cos(\beta) & 0 & \sin(\beta) \\ 0 & 1 & 0 \\ -\sin(\beta) & 0 & \cos(\beta) \end{bmatrix} \qquad \text{Formula 2}$$

$$\begin{bmatrix} 1 & 0 & 0 \\ 0 & \cos(\alpha) & -\sin(\alpha) \\ 0 & \sin(\alpha) & \cos(\alpha) \end{bmatrix}$$

The rotation matrix can be applied to all future accelerometer, gyroscope and magnetometer readings so that the readings from the sensors can be easily interpreted from the same reference frame such that the sensors are aligned using the rotation matrices generated for each sensor. For example, the sensors can be aligned such that all motion of the boom, arm and bucket will be in the X-Z plane with all rotation about the y-axis and such that the swing motion of the upper structure or platform will be registered as rotation about the z-axis on all sensors. Once these rotation matrices are created for each sensor in a known machine orientation then the current orientation of any of the sensors and therefor the machine orientation can be determined by integrating the gyro measurements of angular rate to determine the angle which a the machine has moved through and adding this value to the initial position, as described above.

In an example power-up stage or mode of the equipment 10, following initialization of the overall system, the accelerometers and magnetometers of the sensor units 40 can again be used to determine the orientation and heading of each of the control units 42. The collected data from the accelerometers and magnetometers is processed, using the kinematic model shown in the Figure, to determine initial (i.e., at machine start-up) positions of the various equipment components (chassis, boom, arm, bucket).

In an example operating stage or mode of the equipment 10, following startup of the equipment, and during operating of the equipment, the magnetic field produced by the solenoids that drive the hydraulic valves interferes with the magnetometers' readings of magnetic north. However, the gyroscopes of the sensor units 40 detect the yaw, pitch, and roll rates at each of the control units 42 installed at an actuator 20, and these vectors are transformed into the common coordinate frame using the rotation matrices described above. The transformed vectors of yaw, pitch and roll rates are integrated and added to the initial position values to provide an angle of rotation for each of the sensor units 40, and these angle values are then used to determine the position of the boom, bucket and arm using the kinematic model.

Recalibration of the sensor units 40 is also achievable. For example, periodically when the machine is not being accelerated, the accelerometers of the sensor units 40 are used to re-initialize orientation with respect to the ground 2, since the only acceleration that the accelerometers detect under such conditions is acceleration due to gravity.

An example operating mode of an example mobile hydraulic system will now be described with reference to FIGS. 2-4 and 9.

Figure 3:
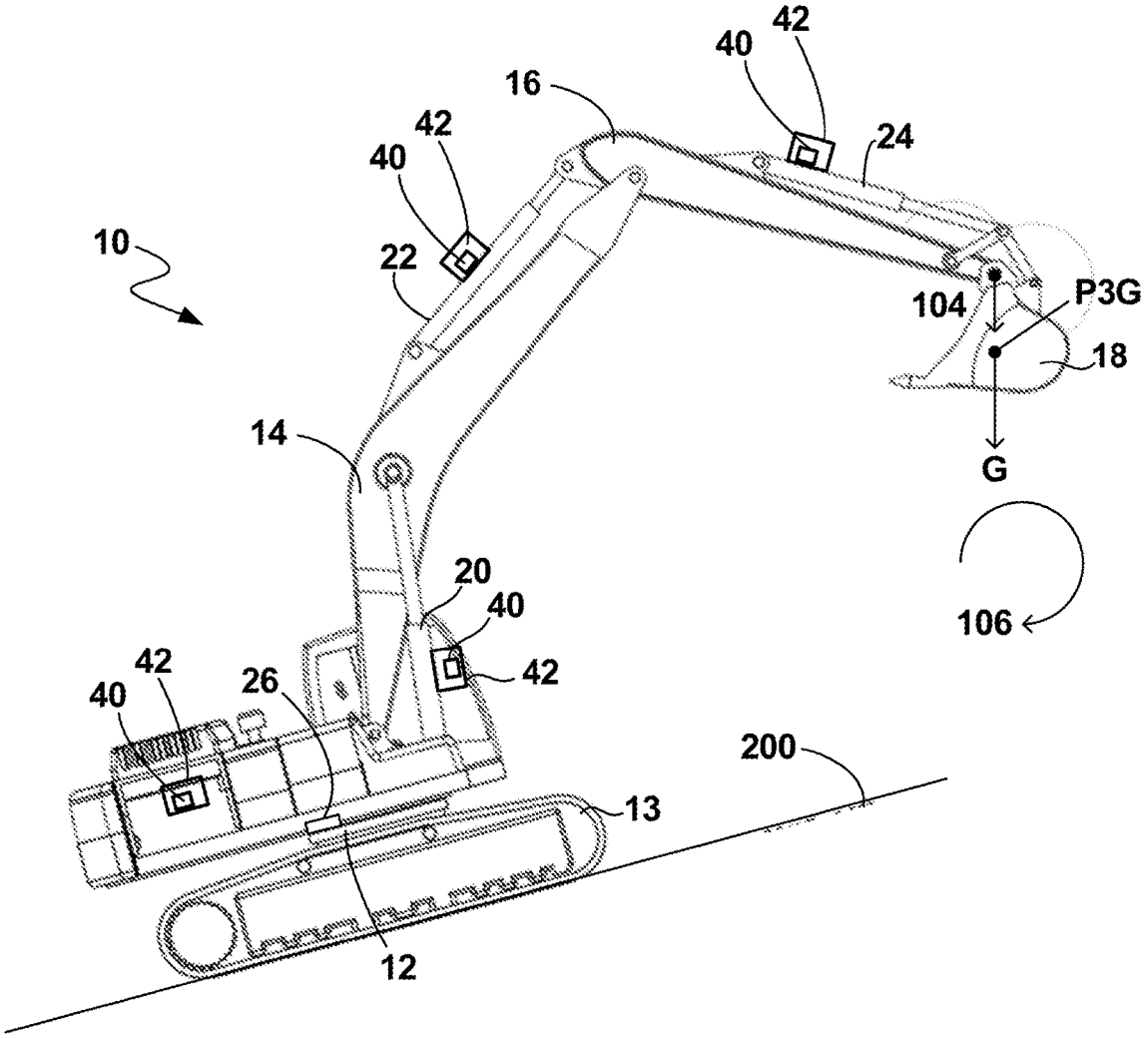
FIG. 3 is a schematic illustration of the piece of a hydraulic machine of FIG. 2, the load being shown at an over-center transition.
Figure 4:
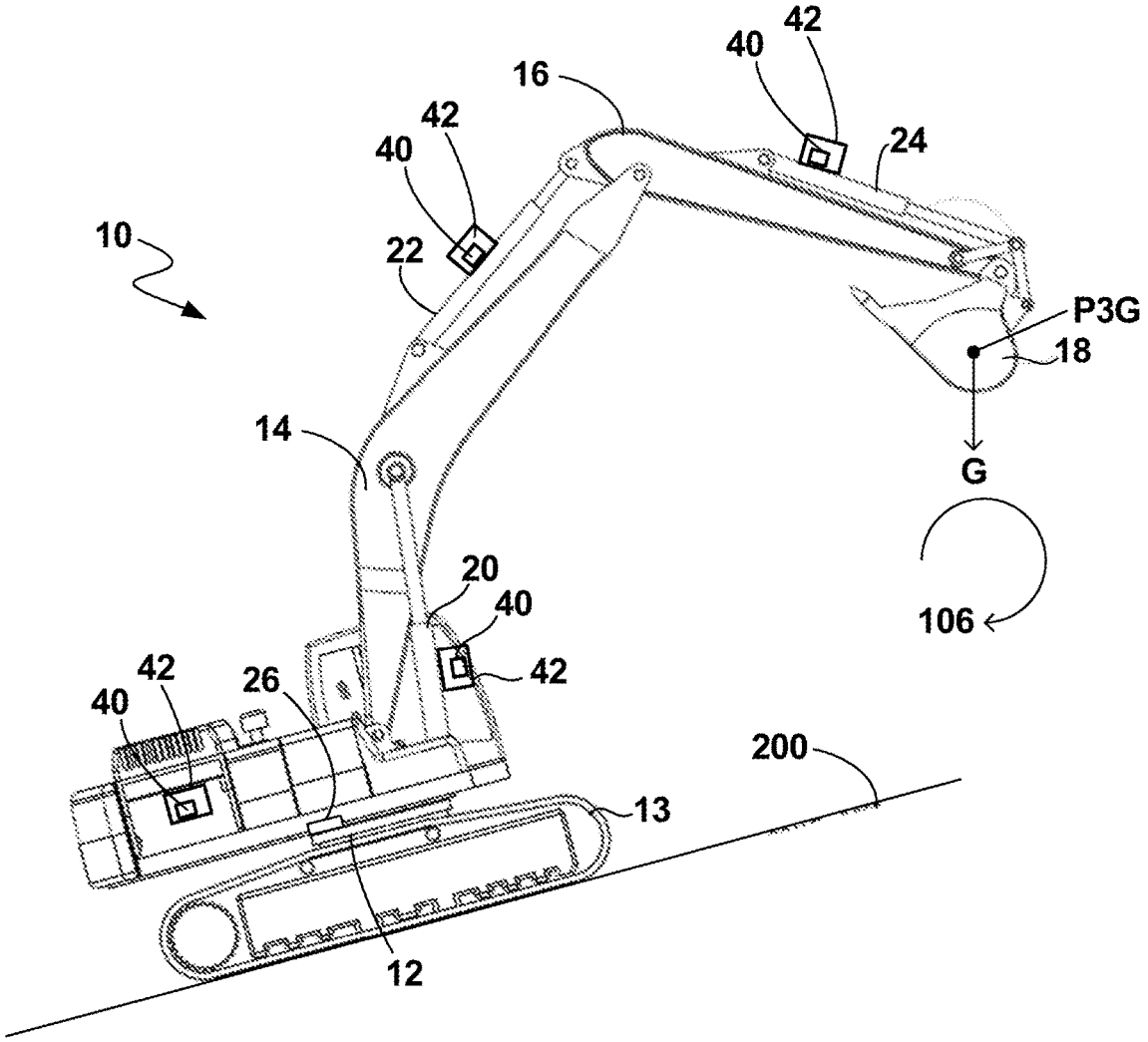
FIG. 4 is a schematic illustration of the piece of a hydraulic machine of FIG. 2, the load being shown after the over-center transition of FIG. 3.
Figure 5:
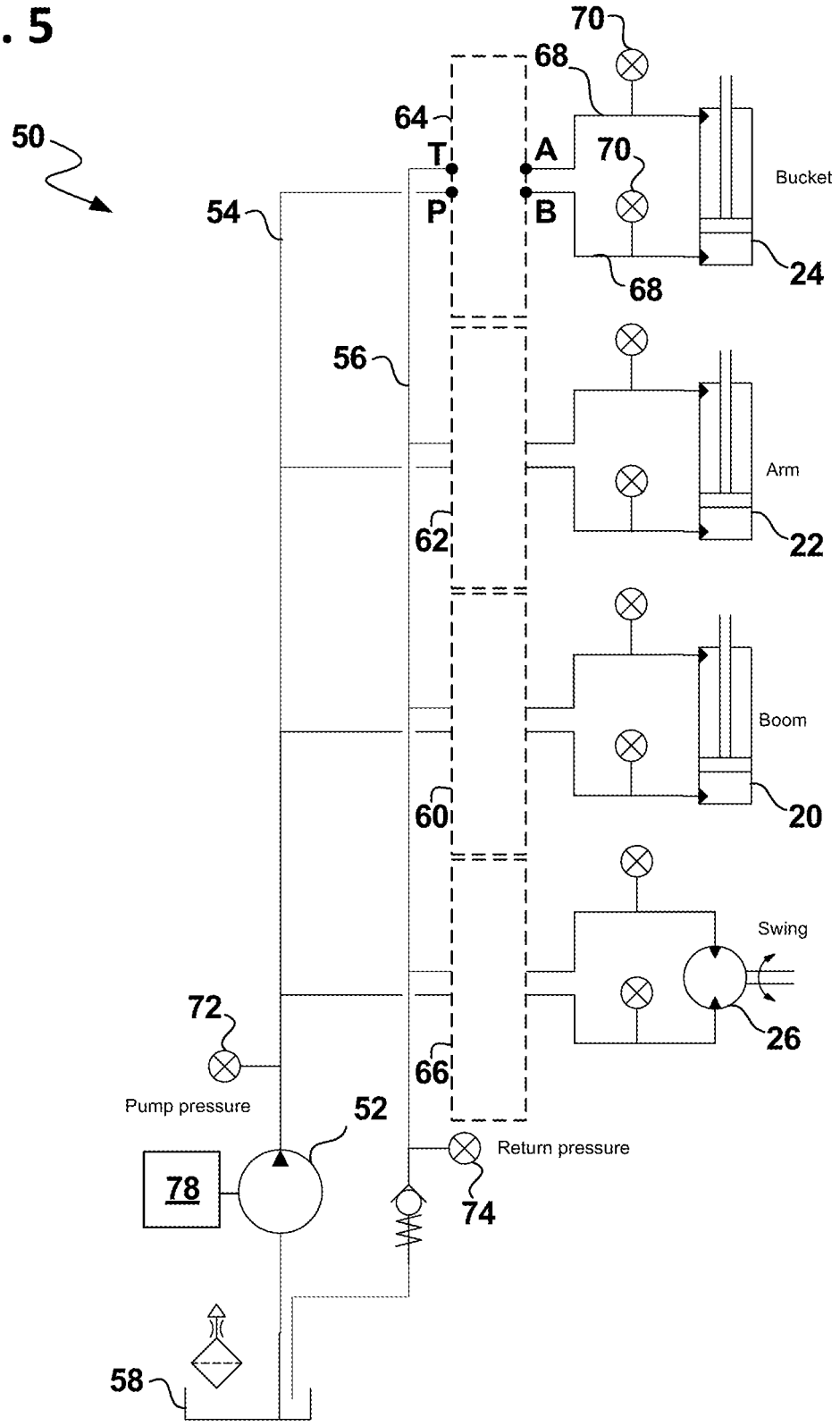
FIG. 5 is a hydraulic schematic associated with the hydraulic machine shown in FIGS. 1 and 1A.

Referring to FIGS. 2-4, mobile hydraulic machine 10 (in this case, an excavator) has a chassis 12 resting on the ground 2. The ground 2 is sloped relative to the vertical direction defined by the gravity vector G. As related previously, mechanically, hydraulically, and electronically coupled to the chassis 12 is a boom 14 hydraulically driven with an associated actuator 20. Fluid flow into and out of the actuator 20 is controlled by the corresponding control unit 42, which is installed on the actuator 20. The control unit 42 controls one or more valve actuators 76 to control the position of one or more valves to control metered flow into and out of the actuator 20. In at least some examples, to provide independent flow metering into and out of the actuator 20, equipment 10 includes independently controlled metering valves for each port of the actuator 20, as shown at FIG. 6. Mechanically, hydraulically, and electronically coupled to the boom 14 and/or the chassis 12 is an arm 16, which also has an associated hydraulic actuator 22 and corresponding control unit 42. Mechanically, hydraulically, and electronically coupled to the boom 14 and/or the chassis 12 and/or the arm 16 is a bucket 18, which also has an associated actuator 24 and corresponding control unit 42. The bucket 18 has a center of gravity P3G.

The control units 42 of the hydraulic machine 10 operate in the manners described above to provide control and/or other signals to, or relating to, their corresponding equipment component (chassis, boom, arm, bucket). Using data from their sensors (accelerometer, magnetometer, gyroscope) the control units 42 are adapted to determine positioning and motion of their corresponding equipment component or actuator, e.g., by detecting rotational movement relative to stored detected initial conditions at start-up.

Also using stored and real-time data from the sensors, each of the control units 42 associated with the boom 14, the arm 16, and the bucket 18 is also adapted to anticipate an over-center transition of its corresponding equipment component or actuator. The over-center anticipation function of a control unit 42 will now be described with reference to the bucket 18 as an example.

In FIG. 2, the bucket 18 is being driven by its corresponding actuator 24 to pivot in the direction indicated by the arrow 106. Thus, in FIG. 2, the driving pivot motion caused by the hydraulic actuator 20 associated with the load 114 is overrunning, because gravity is assisting the pivoting motion.

In FIG. 3, the bucket 18 continues to be pivotally driven in the direction of the arrow 106 and is momentarily positioned at the over-center point in the action arm represented by the arrow 104 (in which the center of gravity P3G of the bucket 18 and the pivot point P24 of the bucket 18 are vertically aligned and parallel to the gravity force vector G.

In FIG. 4, the bucket 18 continues to be pivotally driven in the direction of the arrow 106, and the driving pivot motion caused by the hydraulic actuator 20 is passive, because gravity is now resisting the pivoting motion of the bucket 18.

The control unit 42 associated with the actuator 20 of the bucket 18 is adapted to process position information to determine a position and/or direction of motion of the center of gravity P3G of the bucket 18 relative to the gravity vector g and thereby anticipate the over-center point depicted in FIG. 3. It should be appreciated that the same principles apply in the scenario in which the pivoting motion of the bucket 18 is opposite to the arrow 104 and the bucket 18 pivots from the position depicted in FIG. 4 to the position depicted in FIG. 2 via the over-center point depicted in FIG. 3.

In some examples, the control unit 42 associated with the actuator 20 of the bucket 18 is adapted to anticipate the over-center point by at least a minimum predefined period of time before reaching the over-center point and/or at least a predefined minimum distance before reaching the over-center point.

In some examples, the control unit 42 associated with the actuator 24 of the bucket 18 uses position and/or motion data provided by the other control units 42 in order to anticipate an over-center event.

Once an over-center event is anticipated, in some examples, the control unit 42 associated with the actuator 20 of the bucket 18 generates control signals to adjust flow into and out of the bucket actuator 24 to at least partially counteract one or more phenomena associated with passing the over-center point.

The transition that occurs at an over-center event can cause pressure oscillations which result in undesirable operation including, e.g., jerky movement, pump instability, and valve control instability. In conventional systems, damping is used to counteract over-center events; however, such damping can result in additional and unnecessary power consumption and heat generation. Traditional directional control valves must maintain stability in all possible conditions which can result in very high meter out pressures. Independent metering valve systems can reduce these losses by maintaining a minimum meter out pressure to maintain stability during the over-center transition. However, if only pressure measurements are used, then this minimum meter out pressure is maintained even when the position of the structure is such that there is no chance of an over-center transition, resulting in wasted energy and unnecessary heat generation.

According to the systems and devices of the present disclosure, however, the control units 42, uses the machine geometry, motion, and positioning data of the combined structure (e.g., the chassis, boom, arm, and bucket) to predict the over-center transition and cause an increase in the meter out pressure only in that situation, i.e., only when actually needed or only when probably needed, thereby resulting in energy and heat savings.

Although an over-center transition and control approach are shown and described for the cylinder 24 associated with the bucket 18, this same principle is fully applicable for predicting over-center transitions for the actuators 20, 22, and 26 as the center of gravity of each movable component of the system are known. For example, an over-center transition for the boom actuator 20 can be predicted based on the sensed conditions and positions of the chassis 12, arm 16 and bucket 18 via their associated sensor units 40.

In an alternative embodiment, a velocity control algorithm, rather than a pressure control algorithm, is implemented by the relevant control unit 42 in the region of the equipment where the over-center transition is anticipated to occur. Using a velocity control algorithm rather than a pressure control algorithm can, e.g., avoid using a rapidly changing and potentially oscillatory pressure signal from the control loop.

Another example use embodiment for the principles of the present disclosure is a rotary load, such as a swing service on an excavator. This type of equipment can be subject to over-center transitions when, e.g., the equipment is not on level ground. In this case, the over-center event occurs when the boom is pointed uphill or downhill. The angle of the boom with respect to the slope can be determined using the direction of the acceleration vector due to gravity, which will reach a maximum and a minimum angle with respect to the plane of rotation as the boom is pointed straight uphill or straight downhill, respectively. The techniques described above for controlling the motion while preventing pressure oscillations can be applied to the swing, allowing the meter out pressure to be held near zero up until the transition region or transition point, at which point the system provides an increase in meter out pressure.

Figure 9:
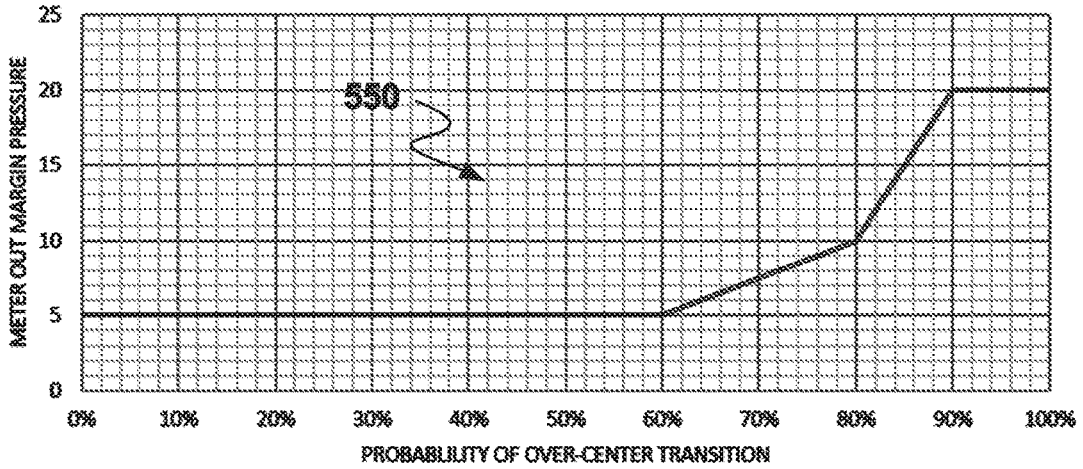
FIG. 9 is a plot showing an example relationship between a meter out margin pressure of the control valve assembly of FIG. 6 angle and a probability of over-center transition of the component controlled by the control valve assembly.
Figure 10:
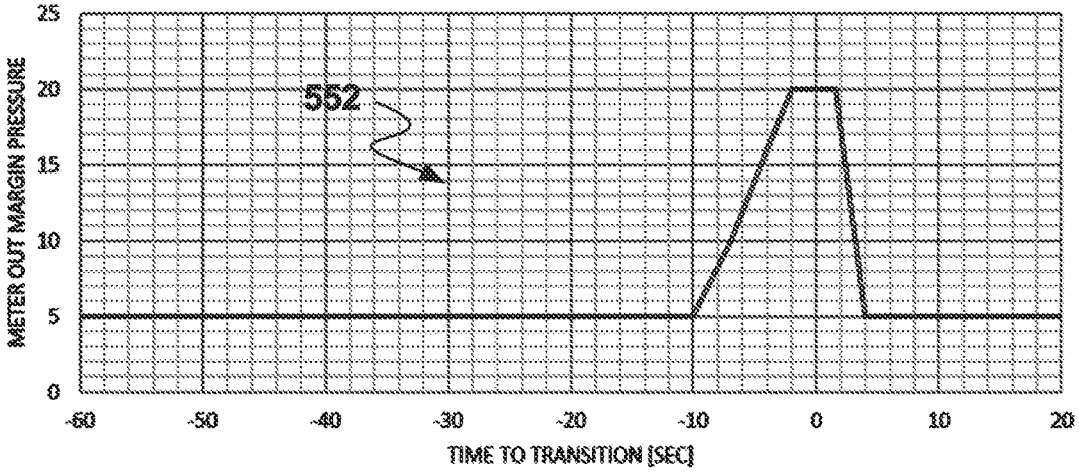
FIG. 10 is a plot showing an example relationship between a meter out margin pressure of the control valve assembly of FIG. 6 angle and a time to over-center transition of the component controlled by the control valve assembly.
Figure 11:
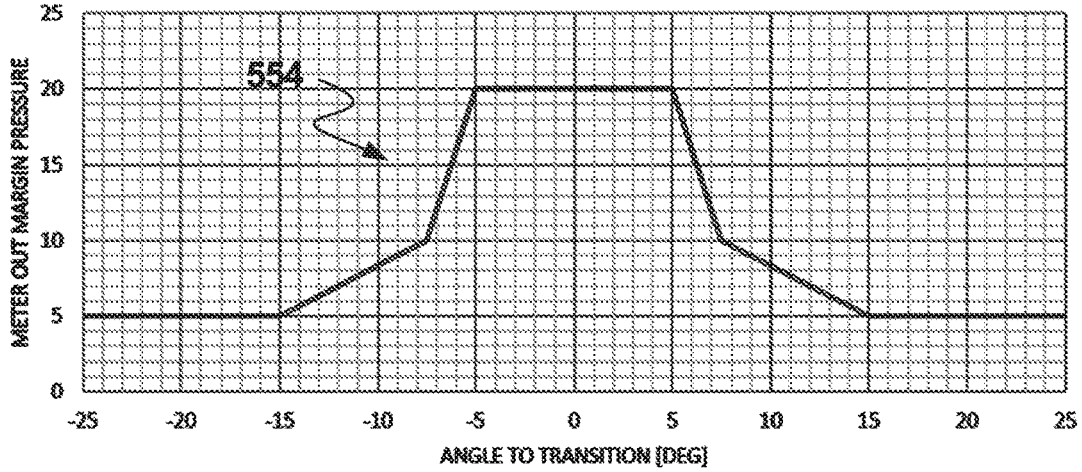
FIG. 11 is a plot showing an example relationship between a meter out margin pressure of the control valve assembly of FIG. 6 angle and an angle to over-center transition of the component controlled by the control valve assembly.

In some example implementations, and with reference to FIGS. 9-11, data from the sensor units 40 can be used to increase the meter-out pressure margin of the control valve associated with an actuator as the over-center transition condition is approached. In FIG. 9, a plot 550 is shown where the meter out pressure is raised (e.g. valve V3 or V4 is moved towards the closed position) to provide damping as a function of the probability of an over-center event occurring. The probability percentage can be calculated as a function of the rotational angle to the over-center transition and/or the time to reach the over-center transition at current velocity and acceleration. In FIG. 10, a plot 552 is shown where the meter out pressure is raised as a function of the time to over-center transition, where the time is calculated as the angular displacement until the center of gravity is below the pivot divided by the current angular velocity of the service. Negative times represent time before the over-center event has occurred and positive times represent times after the over-center event has occurred. For very low velocities it may be advantageous to use position based rather than time based criteria for increasing meter out pressure. The plot 554 at FIG. 11 shows this case. In such implementations, it may be beneficial to use a 2D lookup table to determine the desired meter out pressure as a function of both the angle to transition and the angular velocity of the actuator so that there is not a discontinuity in the desired meter out pressure that would occur if switching from a time based approach (FIG. 10) to an angle based approach (FIG. 11). In some examples, the target meter out pressure margin is achieved by estimating the meter out valve area required given the current velocity using the formula:

$$A = k\frac{V * a}{\sqrt{P_{target} + P_{return}}} \qquad \text{Formula 3}$$

Where:

A=meter out valve area

Figure 8:
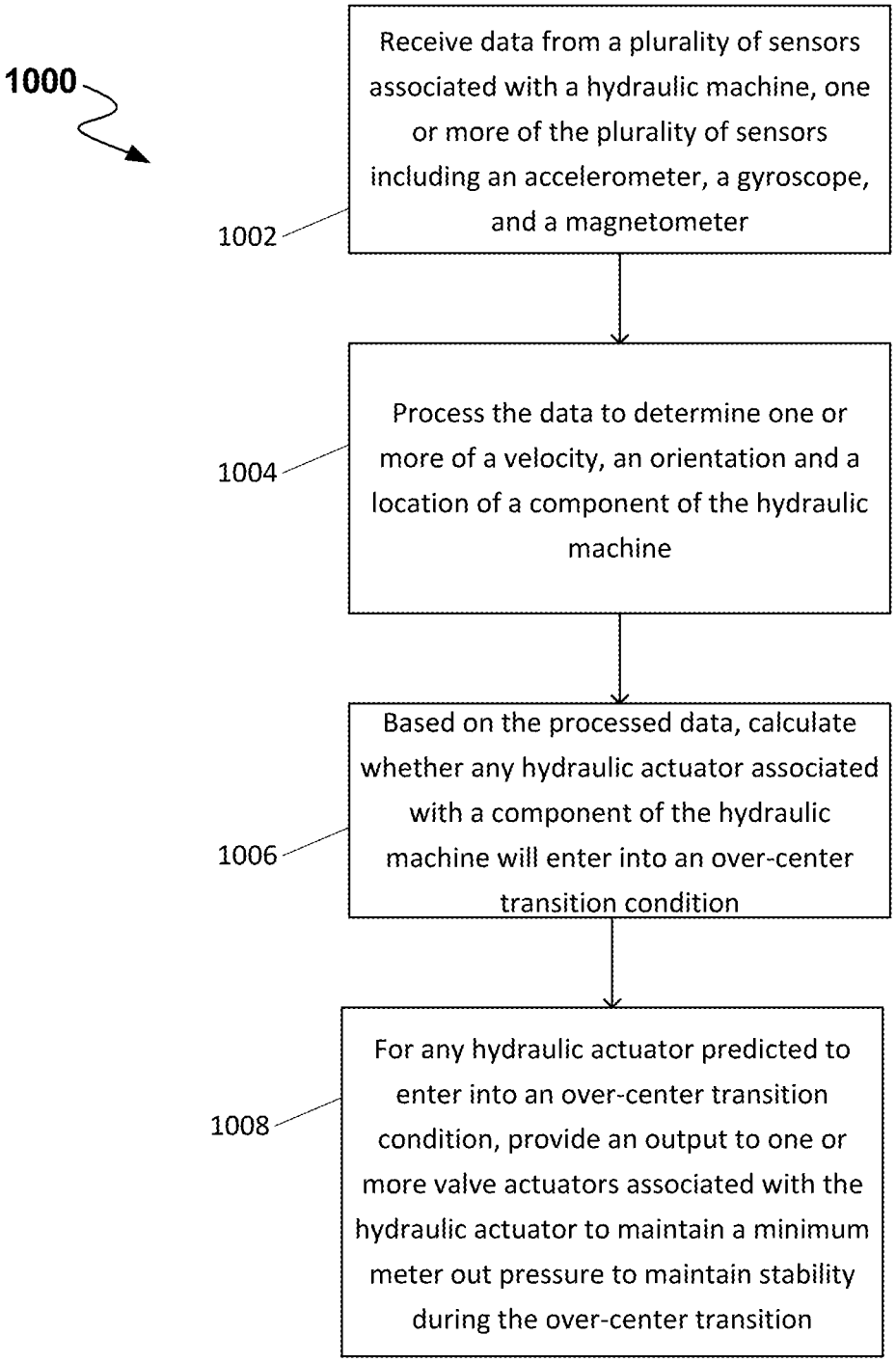
FIG. 8 is a schematic flow chart showing a process that can be implemented by the control system shown at FIG. 7.

V=actuator velocity a=cylinder area on meter out side k=valve specific constants $P_{target}$=target meter out pressure margin $P_{return}$=return line pressure Referring to FIG. 8, a schematic is presented showing the generalized operation 1000 of the control system. In a step 1002, the system receives data from a plurality of sensors associated with a hydraulic machine. In some examples, one or more of the plurality of sensors include an accelerometer, a gyroscope, and a magnetometer. In a step 1004, the data is processed to determine one or more of a velocity, an orientation and a location of a component of the hydraulic machine. In a step 1006, the system can use the processed data to calculate or predict whether any hydraulic actuator associated with a component will enter into an over-center transition condition. Example components of the hydraulic machine can include, as related above, the chassis, boom, arm, and end effector (e.g. bucket). In a step 1008, for any hydraulic actuator predicted to enter into an over-center transition condition, the control system can provide an output to one or more valve actuators associated with the hydraulic actuator to maintain a minimum meter out pressure to maintain stability during the over-center transition. As stated previously, the valve actuators are only activated to maintain a minimum meter out pressure only in circumstances when the over-center transition condition is expected to occur, thereby providing an improved system in comparison to systems that must maintain a minimum meter out pressure at all times regardless of the operating condition of the actuator. As stated previously, either a pressure control algorithm or a velocity control algorithm can be implemented to effectuate step 1008 of the process 1000.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A mobile hydraulic system, comprising:

a hydraulic actuator coupled to a load;

a control valve; and a control unit operatively coupled to the load and/or to the hydraulic actuator, the control unit being adapted to adjust a meter-out pressure of the control valve as a function of a probability that an over-center transition of the load relative to a gravity vector will occur.

2. The system of claim 1, wherein the control unit is adapted to increase the meter-out pressure as a function of the probability only when the probability exceeds a predefined minimum probability.

3. The system of claim 2, wherein the predefined minimum probability is at least 60 percent.

4. The system of claim 1, wherein the control unit is adapted to continuously increase the meter-out pressure as the probability increases.

5. The system of claim 4, wherein a rate of increase of the meter-out pressure increases as the probability increases.

6. The system of claim 1, wherein the function is a linear function.

7. The system of claim 1, wherein the control unit stops increasing the meter-out pressure as a function of the probability only when the probability reaches a predefined maximum probability.

8. The system of claim 7, wherein the predefined maximum probably is at least 90 percent.

9. The system of claim 1, wherein the probability is calculated as a function of a rotation angle of the load or of the hydraulic actuator to the over-center transition.

10. The system of claim 9, wherein the probability is calculated based on a current velocity and a current acceleration of the load or of the hydraulic actuator.

11. The system of claim 1, wherein the probability is calculated as a function of a length of time of the load or of the hydraulic actuator to reach the over-center transition.

12. The system of claim 11, wherein the probability is calculated based on a current velocity and a current acceleration of the load or of the hydraulic actuator.

13. The system of claim 1, wherein the probability is calculated as a function of a rotation angle to the over-center transition and of a length of time to reach the over-center transition of the load or of the hydraulic actuator at a current velocity and a current acceleration of the load or of the hydraulic actuator.

14. The system of claim 1, wherein the over-center transition is a transition from an overrunning driving of the load to a passive driving of the load.

15. The system of claim 1, wherein the over-center transition is a transition from a passive driving of the load to an overrunning driving of the load.

16. The system of claim 1, wherein the system comprises one of: a crane, an excavator, and a loader.

17. The system of claim 1, wherein the control unit includes an accelerometer, a magnetometer, and a gyroscope.

18. A method of controlling metered flow through a control valve associated with a hydraulic actuator adapted to drive a load, comprising:

calculating a probability that an over-center transition of the load relative to a gravity vector will occur; and adjusting a meter-out pressure of the control valve as a function of the probability.

19. The method of claim 18, wherein the probability is calculated as a function of a rotation angle of the load or of the hydraulic actuator to the over-center transition.

20. The method of claim 18, further comprising:

starting to increase the meter-out pressure as a function of the probability only when the probability exceeds a predefined minimum probability; and stopping to increase the meter-out pressure as a function of the probability only when the probability reaches a predefined maximum probability.

* * * * *